US007943564B1

(12) United States Patent
Karniotis Thomas et al.

(10) Patent No.: US 7,943,564 B1
(45) Date of Patent: May 17, 2011

(54) HYDROFLUOROCARBON CLEANING COMPOSITIONS

(75) Inventors: Christina A. Karniotis Thomas, Bedford, OH (US); Timothy P. McNeilly, Westlake, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 194 days.

(21) Appl. No.: 12/356,602

(22) Filed: Jan. 21, 2009

Related U.S. Application Data

(60) Provisional application No. 61/022,379, filed on Jan. 21, 2008.

(51) Int. Cl.
*C11D 7/50* (2006.01)

(52) U.S. Cl. ..... 510/407; 510/365; 134/38

(58) Field of Classification Search ..... 510/365, 510/407; 134/38
See application file for complete search history.

(56) References Cited

U.S. PATENT DOCUMENTS

| | | | | |
|---|---|---|---|---|
| 5,064,559 | A | 11/1991 | Merchant | |
| 5,064,560 | A | 11/1991 | Merchant | |
| 5,100,572 | A | 3/1992 | Merchant | |
| 5,219,490 | A | 6/1993 | Basu | |
| 5,531,916 | A | 7/1996 | Merchant | |
| 5,558,810 | A | 9/1996 | Minor | |
| 5,683,974 | A | 11/1997 | Lund | |
| 5,788,886 | A | 8/1998 | Minor | |
| 5,824,634 | A | 10/1998 | Merchant | |
| 6,191,328 | B1 * | 2/2001 | Kitano et al. | 570/180 |
| RE37,938 | E | 12/2002 | Minor | |
| 6,770,614 | B2 | 8/2004 | Miller | |
| 6,896,823 | B2 | 5/2005 | Hitters | |
| 6,951,835 | B1 | 10/2005 | Minor | |
| 7,169,320 | B2 * | 1/2007 | Hitters et al. | 252/67 |
| 2006/0179852 | A1 * | 8/2006 | Thomas et al. | 62/85 |

FOREIGN PATENT DOCUMENTS

| | | |
|---|---|---|
| EP | 0994089 | 4/2000 |
| EP | 0688860 | 5/2003 |
| EP | 0952177 | 9/2004 |

* cited by examiner

*Primary Examiner* — Gregory E Webb
(74) *Attorney, Agent, or Firm* — Decon A. Cook; Robert E. McDonald; Eryn Ace Fuhrer

(57) ABSTRACT

A cleaning composition suitable for cleaning electronic components includes a blend of hydrofluorocarbons and one or more C1-C5 alcohols. The composition may include from about 1.0 to about 20% by weight of 1,1,1,3,3 pentafluoropropane and from about 75 to about 98.9% by weight of 1,1,1,2,3,4,4,5,5,5 decafluoropentane, and from about 0.1 to about 5% by weight of isopropyl alcohol.

16 Claims, No Drawings

HYDROFLUOROCARBON CLEANING COMPOSITIONS

BACKGROUND OF THE INVENTION

This application claims priority from U.S. Provisional Application 61/022,379 filed Jan. 21, 2008, the entirety of which is incorporated herein by reference.

In response to environmental concerns cleaning compositions containing chlorofluorocarbons (CFC's), which have been widely available for use in cleaning electronic devices, are being phased out. As a result, there is significant need and interest in developing more environmentally stable cleaning compositions that are still effective for use in and around electronics, to clean and remove dust, solder, flux, oils and other similar contaminants that, for example, often attend the manufacture of circuit boards.

In addition to providing environmentally sound, but effective cleaning compositions, it is also important that the cleaner not cause damage to the electronics, or to the other types of substrates commonly found in electronic devices. It is particularly a challenge, but extremely desirable, to provide an effective electronics cleaner that will not harm plastic components and substrates that are widely used in the body of the device or as internal structural elements. Given the wide variety of plastics that can be used in electronic devices, such as polycarbonate (PC), acrylonitrile butadiene styrene (ABS) or PC-ABS blends, it is reasonable that a consumer is not knowledgeable about what specific type(s) of plastic are contained in a particular device. This can make proper selection and use of a cleaner more difficult, as many may be safe for some types of plastic but not others.

The effect of many existing electronics cleaners on plastic can range from aesthetic harm, such as discoloration or a change in gloss, to structural harm, such as melting or crazing. Even if the effect of using these cleaning solutions on plastic parts is a purely aesthetic, it is an extremely undesirable side effect. Notwithstanding, it is a side effect that is difficult to avoid or predict in using existing products. Overspray is common during application and plastic is often so intertwined with the electronics to be cleaned as to make it impractical to apply a cleaner to one but not the other.

There is a need, therefore, for a cleaning composition having sufficient character and robustness to clean contaminated substrates of flux, solder, dust, fingerprints, and the like, and particularly substrates comprising electronics, but which is also safe for plastic components associated with or comprising part of the substrate. The cleaning compositions should sufficiently evaporate so as to leave no or substantially no residue, while being substantially nonflammable, relative non-conductive and having low toxicity. The present invention provides cleaning compositions that addresses this need.

DETAILED DESCRIPTION OF THE INVENTION

According to the present invention, a cleaning composition comprises a hydrofluorocarbon blend, which, in one embodiment may comprise a blend of pentafluoropropane, preferably 1,1,1,3,3 pentafluoropropane, and decafluoropentane, preferably, 1,1,1,2,2,3,4,5,5,5 decafluoropentane. In another embodiment of the invention, the hydrofluorocarbon blend of the composition consists essentially of pentafluoropropane and decafluoropentane.

Fluorinated hydrocarbons have many of desirable qualities for electronic circuit board cleaning. They are non-flammable, have low boiling points, and low toxicity. The dielectric strengths are such that they may safely be used around live circuit boards. However, the kB values of hydrofluorocarbons vary greatly. kB value is a measure of a solvent's "power" relative to other solvents. Generally, the higher the kB value, the stronger the solvent, the better cleaner it will be. Some hydroflourocabons are excellent in cleaning, but can etch or cause hazing to plastics. At the other end of the spectrum, some are not effective cleaners of flux and other contaminants.

Pentafluoropropane (kB=18, as measured according ASTM D 1133) has a sufficiently high kB value to provide robust cleaning properties, particularly as a degreasing agent. Notwithstanding the preference indicated above for 1,1,1,3,3 pentafluoropropane (HFC-245fa) in the compositions of the present invention, it is contemplated that in other embodiments, the other isomers or a blend of isomers of pentafluoropropane, such as 1,1,2,2,3-pentafluoropropane (HFC-245ca), 1,1,1,2,2-pentafluoropropane (HFC-245cb), 1,1,2,3,3-pentafluoropropane (HFC-245ea), and 1,1,1,2,3-pentafluoropropane (HFC-245eb) may be useful.

Decafluoropentane (kB=9) has been discovered to be a particularly useful co-solvent with pentafluoropropane in the compositions of the present invention. Decafluoropentane is liquid at room temperature and is highly and stably compatible with pentafluoropropane (a gas a room temperature), which is soluble in decafluoropentane. Decafluoropentane is non-flammable and substantially non-conductive.

The compositions of the present invention are described as cleaning compositions or contact cleaners. In this respect, the compositions are suitable for dissolving or otherwise facilitating the removal of contaminants from a substrate to which the composition is applied. Such contaminants may include, but are not limited to, dust, oil and grease, such as may be deposited in the form of fingerprints or smudges, (smoke deposits, and soldering flux.

In some embodiments of the invention, pentafluoropropane may comprise less than about 35% by weight of the hydrofluorocarbons in the cleaning composition. In other embodiments, pentafluoropropane comprises less than about 30% by weight, and, in others, less than about 25% by weight, and in still others, less than about 20% by weight, and in still others, less than about 10% by weight; all with respect to the total weight of hydrofluorocarbons. In each embodiment described, the remaining weight percentage of the hydrofluorocarbon may be supplied as decafluoropentane, or another hydrofluorocarbon, or blends thereof. Hydrofluorocarbon blends of pentafluoropropane and decafluoropentane containing less than about 10% by weight pentafluoropropane are particularly useful in relation to exposure to a wide variety of plastics, including polyvinyl chloride, polyacrylic, polycarbonate, polyethylene, polypropylene, polystyrene, and the like. Thus, a useful blend of hydrofluorcarbons may include from about 80 to about 99% by weight decafluoropentane and from about 1 to about 20% by weight pentafluoropropane. In other embodiments, the hydrofluorocarbon blend may comprise from about 5% to about 20% by weight pentafluoropropane and about 80% to about 95% by weight decafluoropentane. Another useful embodiment of the hydrofluorocarbon blend comprises from about 5% to about 15% by weight pentafluoropropane and in still further useful embodiments, about 5% to about 10% by weight pentafluoropropane. The remaining hydrofluorocarbon of the hydrofluorocarbon blend may consist essentially of decafluoropentane.

Some embodiments of the cleaning compositions of the present invention may further comprise an amount of an alcohol, which may be present to displace moisture and clean ionic contaminants. The alcohol may be a C1 to C5 alcohol, such as methanol, ethanol, propanol, isopropanol (isopropyl alcohol), or butanol (butyl alcohol), including 1-butanol, 2-butanol, or t-butanol. Isopropanol is particularly useful for enhancing the solubility of the pentafluoropropane and it forms an azeotrope with the 1,1,1,2,2,3,4,5,5,5-decafluoropentane.

Where present, the alcohol may comprise from about 0.1 to about 5% by weight of the total weight of the alcohol plus hydrofluorocarbons. In still another embodiment, the alcohol may comprise from about 2 to about 4% by weight. In still another embodiment, the alcohol may comprise from about 3 to about 3.5% by weight of the total weight of alcohol plus hydrofluorocarbons.

In one embodiment, a cleaning composition comprises from about 1.0 to about 20% by weight of 1,1,1,3,3 pentafluoropropane, from about 75 to about 98.9% by weight of 1,1,1,2,2,3,4,5,5,5 decafluoropentane, and 1 from about 0.1 to about 5% by weight of isopropyl alcohol.

The compositions of the present invention may be applied to a substrate by any conventional means, including brushing, dipping, rolling, and spraying. However, the compositions of the present invention are particularly useful for aerosol spraying applications. Thus, it is contemplated that the cleaning compositions described above may be blended and packaged with a conventional propellant to create an aerosolized cleaning composition. Suitable propellants will preferably, but not necessarily be nonflammable, and may include carbon dioxide, nitrogen, air, nitrous oxide, HFC-134a propellants, and blends thereof. A particularly useful propellant in some embodiments is 1,1,1,2 tetrafluoroethane. A suitable amount of propellant may be added to propel an amount of the cleaning composition comprising the hydrofluorocarbon blend and other optional components of the cleaning composition. In many embodiments, it is useful to provide a sufficient quantity of propellant to substantially exhaust the cleaning composition from its packaging.

The compositions of the present invention are suitable for application to a variety of substrates of metal, glass, plastic, ceramic, stone, and combinations thereof. It is particularly useful as a cleaner for electronics and electrically conducting devices, such as computer components (keyboards, monitors, drives, and other hardware), circuit boards, televisions and stereo equipment, vehicle components and the like. These substrates are often subject to contamination by dust, fingerprints, soldering flux, and the like. It is, therefore contemplated, that according to one aspect of the invention, a method for removing contaminants from a substrate, comprises the step of applying to a contaminated substrate a cleaning composition as previously described. The cleaning composition may remove contaminants by dissolving the contaminant (namely, grease and oil), wherein the contaminant is removed as the composition evaporates from the substrate. Additionally, aerosolized compositions may operate to dislodge and blow contaminants (particulates, dust, and the like) from the substrate.

Compositions according to the present invention may be substantially residue free, substantially or completely free of classified hazardous air pollutants (HAPS), substantially or completely non-chlorinated, substantially or completely non-flammable, while having low levels of volatile organic compounds (VOCs), and excellent dielectric properties. The dielectric properties of the compositions may be particularly useful for electrical and electrically conducting parts. In some embodiments, the dielectric strength of the composition may be greater than about 12 kV, and in other embodiment, between about 12 and about 13 kV.

For a more complete understanding of the present invention, reference is made to the following illustrative examples.

Example 1

A cleaning composition (CC1) was prepared by blending 90 weight percent 1,1,1,2,2,3,4,5,5,5-decafluoropentane, 7 weight percent 1,1,1,3,3-pentafluoropropane and 3 weight percent isopropyl alcohol. The 1,1,1,2,2,3,4,5,5,5-decafluoropentane was added to a beaker. The isopropanol was added with mild agitation. The 1,1,1,3,3-pentafluoropropane was bubbled into the mixture below the liquid surface ion a closed container.

The kB value of composition CC1 was calculated at 11.4 according to the procedure layed out in ASTM D 1133.

Example 2

To test the compatibility of composition CC1 on plastic, an amount of the composition was applied to stressed polycarbonate and unstressed polycarbonate and unstressed polycarbonate/acrylonitrile butadiene styrene blend. In order to stress the polycarbonate, strips of polycarbonate plastic were placed under a flexing stress. To flex the strip, the strip was placed against two upright posts mounted on the horizontal face of a portion of angle iron. A screw was threaded through the vertical face of the angle iron equidistant from the upright posts. With the plastic strip held against the upright posts, the thumb screw was tightened until it impacted the plastic strip. Further tightening of the screw created a flexing stress in strip a point between the two upright posts. The cleaning composition was applied directly to the plastic strip at a point on the opposite face of the plastic which was in contact with the screw, but immediately over the point of contact.

In both stressed and unstressed testing, the plastic was first evaluated for the appearance of cracking or hazing immediately after the cleaning composition had evaporated. In the stressed test, those plastic samples showing no immediate effects were allowed to sit under stress for a period of 24 hours and subsequently reexamined for the appearance of cracking or hazing. Composition CC1 was tested along side several other cleaning compositions. The results are shown in Table 2.

TABLE 2

Effects of solvents on stressed PC and unstressed PC and PC-ABS blend.

| Composition | Stressed PC | Unstressed PC | Unstressed PC-ABS blend | kB |
|---|---|---|---|---|
| CC1 | NC/NH | NC/NH | NC/NH | 11.4 |
| 60 wt. % 1,1,1,2,2,3,4,5,5,5-decafluoropentane<br>20 wt. % 1,1,1,3,3-Pentafluoropropane<br>20 wt. % methyl acetate | C | NC/NH | H (minor) | 31 |

TABLE 2-continued

Effects of solvents on stressed PC and unstressed PC and PC-ABS blend.

| Composition | Stressed PC | Unstressed PC | Unstressed PC-ABS blend | kB |
|---|---|---|---|---|
| 60 wt. % 1,1,1,2,2,3,4,5,5,5-decafluoropentane 40 wt. % methyl acetate | C | None | H (minor) | 53 |
| 80 wt. % 1,1,1,2,2,3,4,5,5,5-decafluoropentane 17 wt. % 1,1,1,3,3-Pentafluoropropane 3 wt. % isopropanol | C (after 24 hours under stress) | H | H | 16.8 |
| 90 wt. % 1,1,1,2,2,3,4,5,5,5-decafluoropentane 10 wt. % methyl acetate | C | NC/NH | H | 22 |
| 1,1,1,3,3-Pentafluoropropane | H | H | H | 18 |
| 1,1,1,3,3-pentafluorobutane | C | NC/NH | NC/NH | 14 |
| 1,1-dichloro-1-fluoroethane | C | H | H | 56 |
| 1,1,1,2-tetrafluoroethane | NC/NH | NC/NH | NC/NH | 8 |
| 1,1,1,2,2,3,4,5,5,5-decafluoropentane | NC/NH | NC/NH | NC/NH | 9 |
| Trans, 1,2-dichloroethylene | C | H | H | 117 |
| n-Propyl Bromide | C | H | H | 125 |

NC = no cracking
NH = no hazing
C = appearance of cracks
H = appearance of haze

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. A cleaning composition comprising a hydrofluorocarbon blend consisting essentially of:

(a) from about 1 to about 30% by weight of 1,1,1,3,3 pentafluoropropane, and (b) from about 70 to about 99% by weight 1,1,1,2,2,3,4,5,5,5 decafluoropentane.

2. The cleaning composition of claim 1, wherein the hydrofluorocarbon blend comprises:

(a) from about 5 to about 20% by weight of 1,1,1,3,3 pentafluoropropane; and (b) from about 80 to about 95% by weight of 1,1,1,2,2,3,4,5,5,5 decafluoropentane.

3. The cleaning composition of claim 2, wherein the hydrofluorocarbon blend comprises:

(a) from about 5 to about 15% by weight of 1,1,1,3,3 pentafluoropropane; and (b) from about 85 to about 95% by weight of 1,1,1,2,2,3,4,5,5,5 decafluoropentane.

4. The cleaning composition of claim 1, further comprising an alcohol.

5. The cleaning composition of claim 4, wherein the alcohol is a C1-C5 alcohol.

6. The cleaning composition of claim 5, wherein the alcohol is isopropyl alcohol.

7. A cleaning composition comprising:

(a) from about 1.0 to about 20% by weight of 1,1,1,3,3 pentafluoropropane;

(b) from about 75 to about 98.9% by weight of 1,1,1,2,2,3,4,5,5,5 decafluoropentane; and (c) from about 0.1 to about 5% by weight of isopropyl alcohol.

8. A sprayable cleaning composition comprising:

(a) the cleaning composition of claim 7; and (b) a propellant.

9. A method for cleaning a substrate, comprising the step of applying to a substrate a cleaning composition comprising:

(1) pentafluoropropane, and (2) decafluoropentane; and wherein the cleaning composition comprises less than about 35% by weight with respect to the total weight of pentafluoropropane and decafluoropentane, of pentafluoropropane.

10. The method of claim 9, wherein the cleaning composition comprises less than about 20% by weight with respect to the total weight of pentafluoropropane and decafluoropentane, of pentafluoropropane.

11. The method of claim 10, wherein the cleaning composition comprises from between about 5 to about 20% by weight of pentafluoropropane, with respect to the total weight of pentafluoropropane and decafluoropentane.

12. The method of claim 10, wherein the pentafluoropropane is 1,1,1,3,3 pentafluoropropane.

13. The method of claim 9, wherein the cleaning composition further comprises isopropyl alcohol.

14. The method of claim 13, wherein the cleaning composition comprises:

(a) less than about 20% by weight with respect to the total weight of pentafluoropropane, decafluoropentane and isopropyl alcohol of 1,1,1,3,3 pentafluoropropane;

(b) greater than about 75% by weight of 1,1,1,2,3,4,5,5,5 decafluoropentane; and (c) less than about 5% by weight of isopropyl alcohol.

15. The sprayable cleaning composition of claim 8, wherein the propellant is selected from the group consisting of carbon dioxide, nitrogen, air, nitrous oxide, HFC-134a propellant, and 1,1,1,2 tetrafluoroethane.

16. The method of claim 9 wherein the cleaning composition is applied by one or more application means selected from brushing, dipping, rolling, and spraying.

* * * * *

UNITED STATES PATENT AND TRADEMARK OFFICE

CERTIFICATE OF CORRECTION

PATENT NO. : 7,943,564 B1
APPLICATION NO. : 12/356602
DATED : May 17, 2011
INVENTOR(S) : Christina A. Karniotis-Thomas and Timothy P. McNeilly It is certified that error appears in the above-identified patent and that said Letters Patent is hereby corrected as shown below:

In the Claims

Column 6, Line 53, Claim 14, delete "1,1,1,2,3,4,5,5,5", and insert --1,1,1,2,2,3,4,5,5,5--.

Signed and Sealed this
Twenty-sixth Day of May, 2015

Michelle K. Lee

Michelle K. Lee
*Director of the United States Patent and Trademark Office*